US012290741B2

(12) United States Patent
Pellegrino

(10) Patent No.: US 12,290,741 B2
(45) Date of Patent: May 6, 2025

(54) EXERCISE GRIP

(71) Applicant: VICTORY GRIPS LLC, Tybee Island, GA (US)

(72) Inventor: Victor Brian Pellegrino, Tybee Island, GA (US)

(73) Assignee: VICTORY GRIPS LLC, Tybee Island, GA (US)

( * ) Notice: Subject to any disclaimer, the term of this patent is extended or adjusted under 35 U.S.C. 154(b) by 0 days.

(21) Appl. No.: 18/362,148

(22) Filed: Jul. 31, 2023

(65) Prior Publication Data

US 2023/0405442 A1 Dec. 21, 2023

Related U.S. Application Data

(63) Continuation of application No. 17/096,574, filed on Nov. 12, 2020, now abandoned, which is a continuation of application No. 16/594,581, filed on Oct. 7, 2019, now Pat. No. 10,835,804, which is a continuation of application No. 15/589,354, filed on May 8, 2017, now Pat. No. 10,576,356, which is a continuation of application No. 14/644,512, filed on Mar. 11, 2015, now Pat. No. 9,643,073.

(60) Provisional application No. 61/951,872, filed on Mar. 12, 2014.

(51) Int. Cl.

| | |
|---|---|
| ***A63B 71/14*** | (2006.01) |
| *A63B 1/00* | (2006.01) |
| *A63B 7/02* | (2006.01) |
| *A63B 21/00* | (2006.01) |
| *A63B 21/072* | (2006.01) |
| *A63B 26/00* | (2006.01) |

(52) U.S. Cl.

CPC ..... *A63B 71/14* (2013.01); *A63B 71/141* (2013.01); *A63B 1/00* (2013.01); *A63B 7/02* (2013.01); *A63B 21/0724* (2013.01); *A63B 21/4001* (2015.10); *A63B 21/4019* (2015.10); *A63B 21/4021* (2015.10); *A63B 26/00* (2013.01)

(58) Field of Classification Search

CPC ..... A63B 1/00; A63B 7/00; A63B 21/4019; A63B 21/4021; A63B 71/14; A63B 71/141

See application file for complete search history.

(56) References Cited

U.S. PATENT DOCUMENTS

| | | | | | |
|---|---|---|---|---|---|
| 1,126,938 | A | * | 2/1915 | Barrett | G09B 15/06 601/40 |
| 1,200,580 | A | * | 10/1916 | Brenner | A63B 71/146 2/161.3 |
| 2,456,678 | A | | 12/1948 | Dana | |
| 2,566,580 | A | | 9/1951 | Patterson | |
| 2,769,179 | A | * | 11/1956 | Love | F41B 5/1473 D29/113 |
| 3,178,724 | A | | 4/1965 | Perschke | |

(Continued)

*Primary Examiner* — Joshua Lee

(74) *Attorney, Agent, or Firm* — Fish & Richardson P.C.

(57) ABSTRACT

An exercise grip is disclosed. The exercise grip includes a protective portion and a wrist strap connected to a wrist end of the protective portion. The protective portion has a finger end in which three or four finger holes are defined. The protective portion also has a palm portion that extends from the finger holes to the wrist end. The protective portion varies in width from the wrist end to the finger end. The protective portion can be formed to cover an ulnar portion of a wrist when placed on a hand.

18 Claims, 8 Drawing Sheets

(56) References Cited

U.S. PATENT DOCUMENTS 3,421,160 A * 1/1969 Salvatore ..... A63B 71/148 473/59
3,501,773 A * 3/1970 Stansberry ..... A63B 71/148 473/59
3,564,613 A * 2/1971 Fowler ..... A41D 13/088 473/59
4,701,963 A 10/1987 Overton
4,720,279 A 1/1988 Fritschen et al.
4,785,478 A * 11/1988 Mosley ..... A41D 13/084 2/167
4,793,005 A * 12/1988 Hetzel, Jr. ..... A41D 19/01547 482/106
5,033,119 A * 7/1991 Wiggins ..... A63B 71/146 2/161.3
5,079,776 A * 1/1992 Crawford ..... A63B 71/141 2/167
5,195,188 A 3/1993 Bourdeau et al.
5,197,149 A 3/1993 Overton
5,261,299 A * 11/1993 Kondos ..... A41D 19/01594 81/355
5,298,001 A * 3/1994 Goodson ..... A63B 21/4019 2/161.1
D348,090 S * 6/1994 Riley, Jr. ..... D29/116.1
5,350,343 A 9/1994 DaSilva
5,353,440 A 10/1994 Meldeau
5,423,089 A * 6/1995 Chun ..... A63B 71/146 2/907
5,459,883 A * 10/1995 Garceau-Verbeck ..... A63B 71/146 2/161.4
5,513,391 A 5/1996 Garneau et al.
5,634,213 A 6/1997 Grover
5,704,883 A 1/1998 Eckmann
5,740,555 A 4/1998 Renegar
5,813,950 A 9/1998 Parker
5,898,944 A * 5/1999 Vrany ..... A41D 19/01547 2/163
5,924,136 A * 7/1999 Ogean ..... A45C 11/182 2/163
6,035,443 A * 3/2000 Green ..... A63B 71/146 2/907
6,119,267 A * 9/2000 Pozzi ..... A41D 13/088 2/161.1
6,553,576 B1 * 4/2003 Knapp ..... A41D 19/01547 2/163
6,666,795 B2 12/2003 Mah
6,834,397 B1 12/2004 Murphy
7,334,711 B1 * 2/2008 Winters ..... H04B 1/385 224/217
7,475,433 B2 * 1/2009 Coulter ..... A63B 71/141 2/160
8,060,948 B2 * 11/2011 Pesic ..... A45F 5/00 2/163
8,726,418 B2 5/2014 DeBlasis et al.
8,925,113 B2 * 1/2015 Fricke ..... A63B 71/141 2/161.1
9,067,123 B1 * 6/2015 Robbins ..... A41D 19/01547
D741,974 S * 10/2015 Lung ..... D21/698
9,339,693 B1 5/2016 Pegram et al.
9,380,817 B1 * 7/2016 Drake ..... A41D 13/082
9,643,073 B1 5/2017 Pellegrino
D823,573 S * 7/2018 Delarosa ..... D2/617
10,576,356 B1 3/2020 Pellegrino
10,702,761 B2 7/2020 Pellegrino
10,835,804 B1 11/2020 Pellegrino
2004/0018899 A1 1/2004 Thiruppathi
2004/0244088 A1 12/2004 Greenhalgh
2006/0026738 A1 * 2/2006 Kleinert ..... A63B 71/143 2/163
2008/0263747 A1 * 10/2008 DeBlasis ..... A41F 1/06 2/163
2010/0043113 A1 * 2/2010 Clark ..... A41D 13/082 2/20
2014/0373247 A1 * 12/2014 Swaby ..... A63B 71/14 2/69
2018/0140929 A1 5/2018 Pellegrino
2021/0023435 A1 1/2021 Pellegrino
2021/0170258 A1 6/2021 Pellegrino

* cited by examiner

EXERCISE GRIP

CROSS-REFERENCE TO RELATED APPLICATIONS

This application is a continuation application of, and claims priority to, U.S. patent application Ser. No. 17/096,574, entitled "EXERCISE GRIP," filed on Nov. 12, 2020, which is a continuation application of, and claims priority to, U.S. patent application Ser. No. 16/594,581, now U.S. Pat. No. 10,835,804, entitled "EXERCISE GRIP," filed on Oct. 7, 2019, which is a continuation application of, and claims priority to, U.S. patent application Ser. No. 15/589,354, now U.S. Pat. No. 10,576,356, entitled "EXERCISE GRIP," filed on May 8, 2017, which application is a continuation application of, and claims priority to, U.S. patent application Ser. No. 14/644,512, now U.S. Pat. No. 9,643,073, entitled "EXERCISE GRIP," filed on Mar. 11, 2015, which application claims the benefit under 35 U.S.C. § 119(e) of U.S. Patent Application No. 61/951,872, entitled "EXERCISE GRIP," filed Mar. 12, 2014. The disclosure of the foregoing applications is incorporated herein by reference in their entirety for all purposes.

BACKGROUND

This specification relates to an exercise grip. There are many different exercises performed on horizontal bars and gymnastics rings. During these exercises skin that is in contact with the bars or rings experience friction that can lead to injury.

SUMMARY

In general, one innovative aspect of the subject matter described in this specification can be embodied in an exercise grip that includes a wrist strap; and a protective portion connected to the wrist strap at a wrist end of the protective portion, a finger end of the protective portion having three finger holes defined therein the protective portion having a length that extends from the finger end to the wrist end and a width that varies along the length of the protective portion, wherein the wrist end has a first width that covers an ulnar side of a wrist and is larger than a second width of the finger end, and wherein a width of the protective portion that is between the finger end and the wrist end has a third width that is smaller than the second width. The first width of the wrist end can be larger than the third width of the finger end.

These and other embodiments can each optionally include one or more of the following features. The three finger holes can include a middle finger hole, a ring finger hole and a pinky finger hole, and wherein the middle finger hole, ring finger hole, and pinky finger hole are defined at locations at which a middle finger, ring finger, and pinky finger are respectively received when the exercise grip is placed on a hand.

The middle finger hole can be at a first distance from the wrist end, the ring finger hole is at a second distance from the wrist end, and the little finger hole is at a third distance from the wrist end. The first distance can be larger than the second distance and the second distance is larger than the third distance.

The protective portion can be a continuous flexible material. The flexible material can be at least one of leather, neoprene, or rubber.

Other embodiments of this aspect include corresponding methods for making an exercise grip. Methods can include the actions of forming a protective portion of an exercise grip, wherein the protective portion is formed to have a wrist end and a finger end, the finger end having three finger holes defined therein and the protective portion having a length that extends from the finger end to the wrist end, the protective portion having a width that varies along the length of the protective portion, wherein the wrist end has a first width that covers an ulnar side of a wrist and is larger than a second width of the finger end, and wherein a width of the protective portion between the finger end and the wrist end has a third width that is smaller than the second width; and connecting the protective portion to a wrist strap.

These and other embodiments can each optionally include one or more of the following features. Forming the protective portion can include forming the three finger holes in the finger end, the three finger holes comprising a middle finger hole, a ring finger hole, and a pinky finger hole.

Forming the three finger holes can include forming the middle finger hole, ring finger hole, and pinky finger hole at locations at which a middle finger, ring finger, and pinky finger are respectively received when the exercise grip is placed on a hand.

Forming the three finger holes can include forming the middle finger hole at a first distance from the wrist end; forming the ring finger hole at a second distance from the wrist end; and forming the little finger hole at a third distance from the wrist end. The first distance can be larger than the second distance and the second distance is larger than the third distance. The first width of the wrist end can be larger than the third width of the finger end.

Forming the protective portion can include forming the protective portion from a continuous piece of flexible material. The flexible material can be at least one of leather, neoprene, or rubber.

Methods can optionally include forming a fourth finger hole at a location of the protective portion at which an index finger is received when the grip is placed on a hand.

Another innovative aspect of the subject matter described in this specification can be embodied in an exercise grip that includes a wrist strap; and a protective portion connected to the wrist strap at a wrist end of the protective portion, a finger end of the protective portion having three finger holes defined therein the protective portion having a length that extends from the finger end to the wrist end and a width that varies along the length of the protective portion.

Another innovative aspect of the subject matte described in this specification can be embodied in an exercise grip including a wrist strap; and a protective portion connected to the wrist strap at a wrist end of the protective portion, a finger end of the protective portion having four finger holes defined therein the protective portion having a length that extends from the finger end to the wrist end and a width that varies along the length of the protective portion. The four finger holes can be formed at locations at which an index finger, a middle finger, a ring finger, and a pinky finger are respectively received when the grip is placed on a hand.

Particular embodiments of the subject matter described in this specification can be implemented so as to realize one or more of the following advantages. Hand and wrist protection is provided by the exercise grip when worn on a hand. The protection provided can include protecting the hand and wrist from injury caused by friction when performing exercises on horizontal bars, pull up bars, and/or gymnastics rings. Gripping ability of a person wearing the exercise grip is increased by covering portions of the hand that contact bars or rings during exercise.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
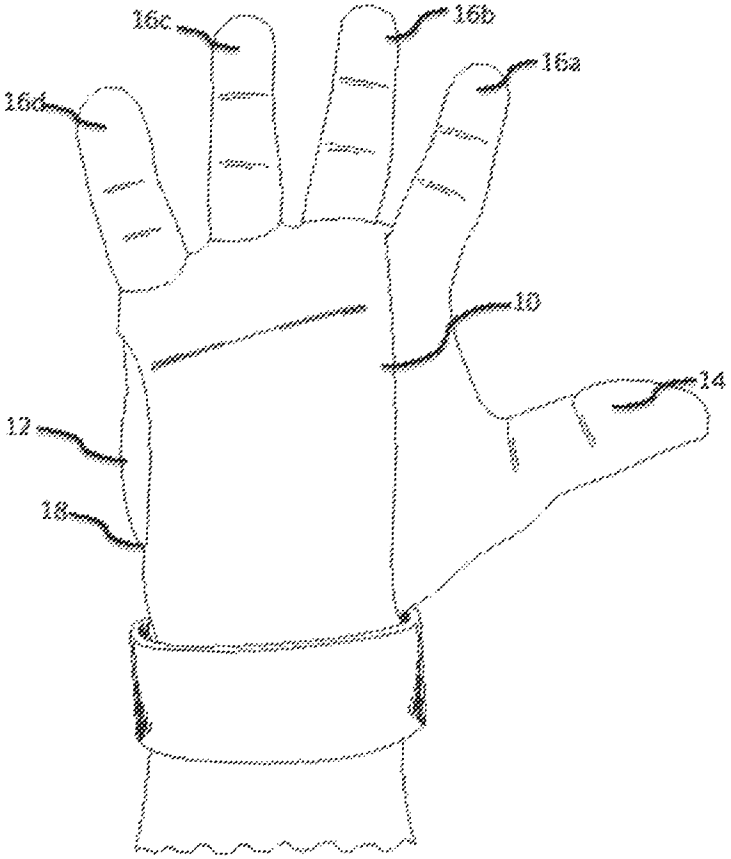
FIG. 1 is a drawing of an example exercise grip on a hand.

FIG. 1 is a drawing of an example exercise grip 10 on a hand 12. The grip 10 is formed to protect the hand 12 and wrist 18 of an individual wearing the grip 10, and enhances the individual's grip on a gymnastics bar or rings. As described in more detail below, the grip 10 includes three finger holes that receive a middle finger 16*a*, ring finger 16*b*, and pinky finger 16*c* of the hand 12 when the grip 10 is worn. In some implementations, the index finger 16*d* and thumb 16*e* of the hand 12 remain uncovered when the grip 10 is worn. In some implementations, the exercise grip can include an index finger hole, as described in more detail below.

Figure 2:
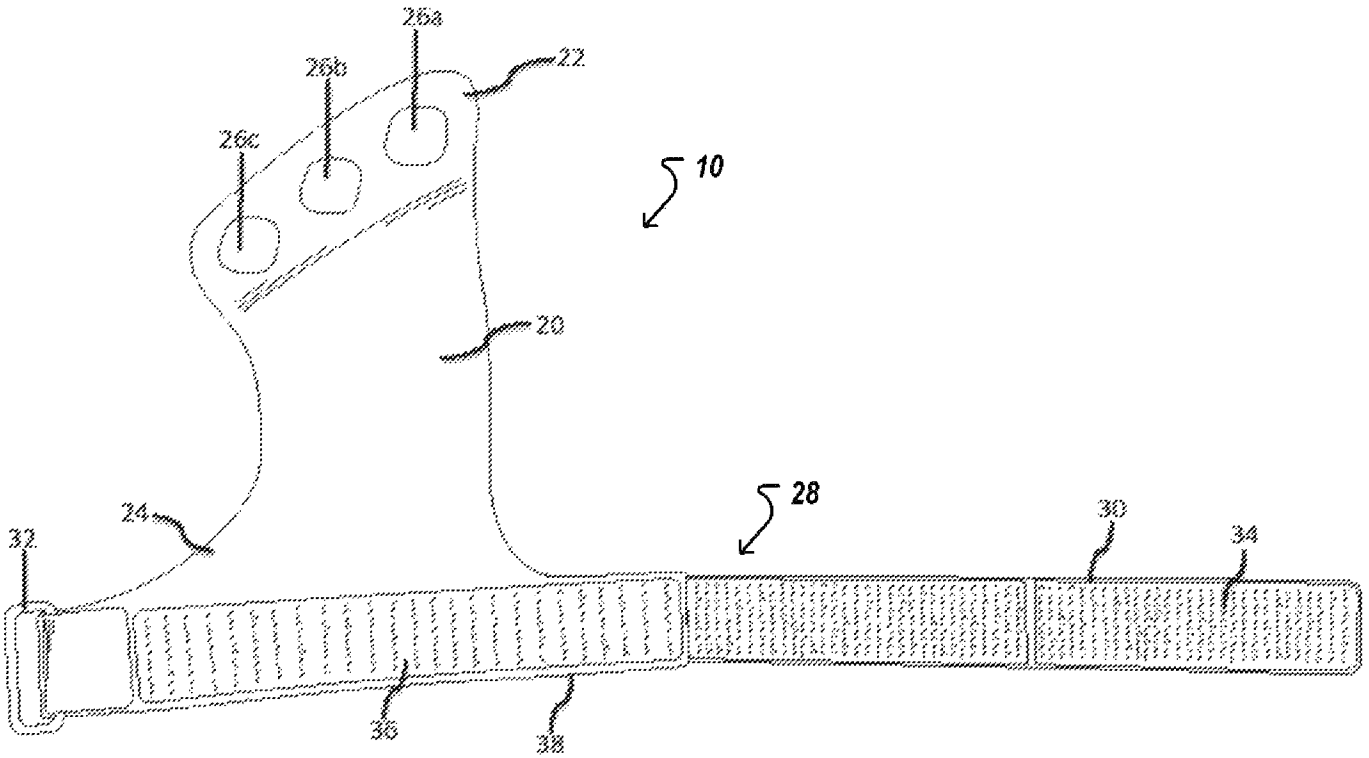
FIG. 2 is another drawing of an example exercise grip.

FIG. 2 is another drawing of an example exercise grip 10. The grip 10 includes a wrist strap 14 and a protective portion 20. The protective portion 20 has a finger end 22 and a wrist end 24 that is connected to the wrist strap 14.

The grip 10 has three finger holes 26*a*, 26*b*, and 26*c* defined therein. The finger holes 26*a*, 26*b*, and 26*c* are defined at the finger end 22 of the protective portion 20. In some implementations, finger hole 26*a* is a middle finger hole that is defined at a location of the protective portion 20 at which a middle finger of a hand is received when the grip 10 is placed on the hand. The finger hole 26*b* is a ring finger hole that is defined at a location of the protective portion at which a ring finger of the hand is received when the grip 10 is placed on the hand. The finger hole 26*c* can be a pinky finger hole that is defined at a location of the protective portion at which a pinky finger of the hand is received with the grip 10 is placed on the hand.

The protective portion 20 can be formed from a continuous piece of flexible material. For example, the protective portion 20 can be made of a high-grade leather or other strong and flexible material allowing appropriate friction and protection. In some implementations, the protective portion 20 can be made of neoprene or a rubber material.

The grip 10 includes a wrist strap 14 for securing the grip 10 about the wrist of an individual. The wrist strap 14 includes a closure strap 30, a cuff 38, and an open loop 32 or wring. In some implementations, the closure strap 30 is located on a side of the grip 10 that will be on a radial side of the wrist when the grip 10 is placed on a hand and the loop 32 is located on a side of the grip 10 that will be on an ulnar side of a wrist when the grip 10 is placed on the hand.

The closure strap 30 can include a hook and loop fastener patch 34 which is adapted to be connected to a corresponding hook and loop fastener patch 36 secured to the portion of the cuff 38 or another portion of the wrist end of the protective portion 20.

Figure 3:
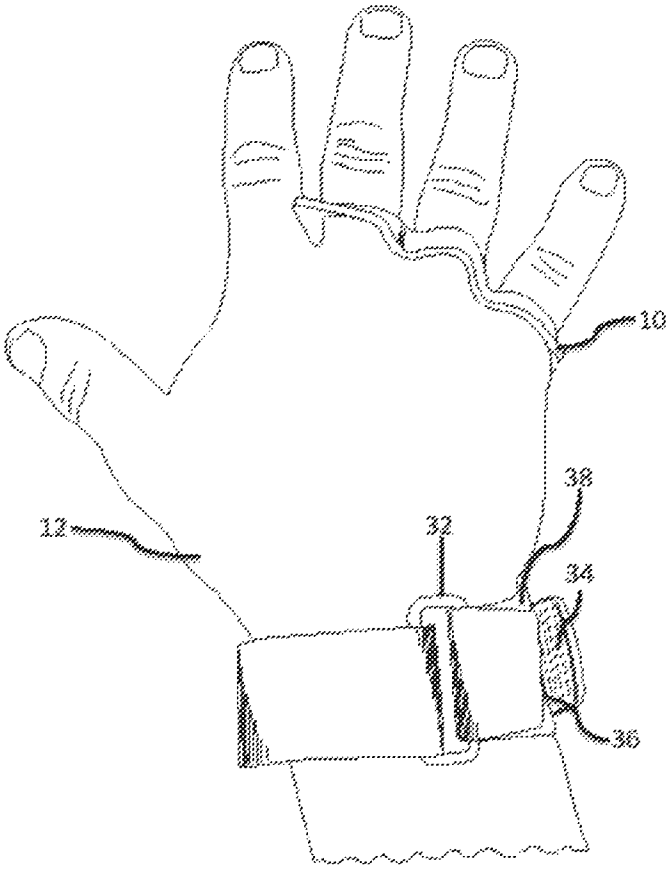
FIG. 3 is a drawing of an example strap assembly for an exercise grip.

As shown in FIG. 3, the closure strap 30 can be fed through the open loop 32 and turned back onto itself to permit the grip 10 to be adjustably fastened to the individual's wrist upon mating the hook and loop fastener patch 34 with the hook and loop fastener patch 36.

Figure 4:
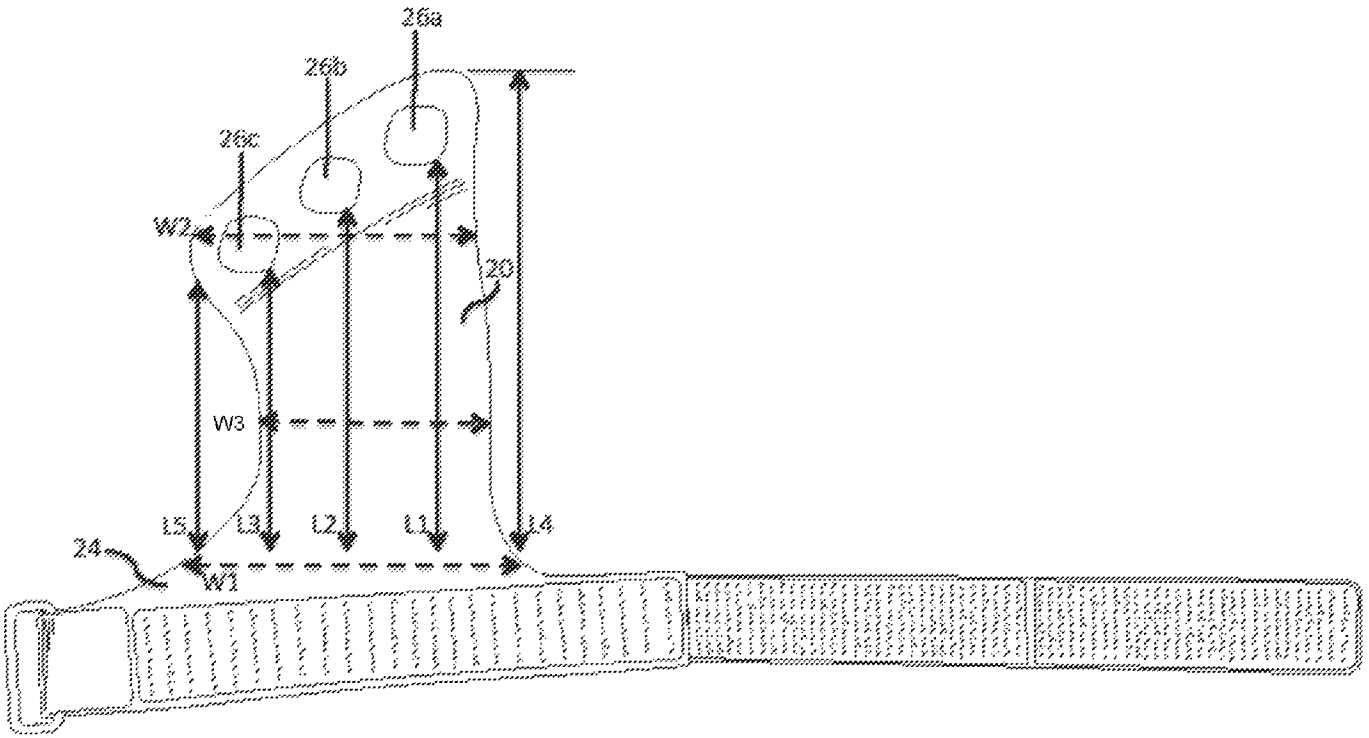
FIG. 4 is another drawing of an example exercise grip.

FIG. 4 is another drawing of an example exercise grip 10, and shows various example lengths and widths of the protective portion 20 of the grip 10. In some implementations, the three finger holes 26*a*, 26*b*, and 26*c* are formed at different distances from the wrist end 24. For example, the finger hole 26*a* can be formed at a first distance L1 from the wrist end 24, the finger hole 26*b* can be formed at a second distance L2 from the wrist end 24, and the finger hole 26*c* can be formed at a third distance L3 from the wrist end 24. In some implementations, the second distance L2 is smaller than the first distance L1 and the third distance L3 is less than the second distance L2. Note that other lengths can be used.

As illustrated by FIG. 4, the length of the protective portion (e.g., as measured from the wrist end 24) varies along the width of the protective portion. For example, the protective portion 10 has a length of L4 near the finger hole 26*a* and smaller length of L5 near the finger hole 26*c*. These varying lengths permit the proper articulation of the hand during exercise.

In some implementations, the protective portion 20 has a width that varies along the length of the protective portion 20. For example, the wrist end 24 can have a first width W1 that covers an ulnar side of a wrist when the grip 10 is worn. The finger end of the grip 10 can have a second width W2 that is smaller than the width W1 of the wrist end 24. The protective portion 20 can also have a third width W3 that is smaller than the width W2. Forming the protective portion 20 to have a width W1 that is larger than each of W2 and W3 allows the wrist end 24 to protect the ulnar side of the wrist, while the width W2 of the finger end permits adequate finger extension and protects the palm immediately under the middle, ring, and pinky fingers. Making the width W3 between the finger end and the wrist end 24 smaller than W1 and W2 increases comfort of the grip 10 and facilitates articulation of the hand.

Figure 5:
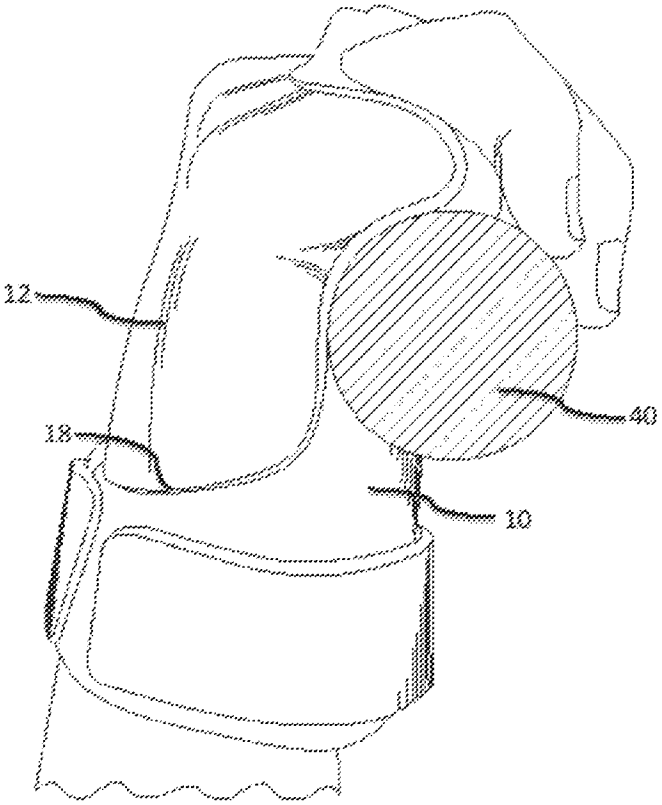
FIG. 5 is a drawing illustrating use of an example exercise grip.

Referring now to FIG. 5, the grip 10 is shown donned on the hand 12 of an individual and being utilized to grip an object, such as a gymnastics ring or bar 40. The construction of the grip 10 permits the individual to grip the ring or bar 40 without having to expend unnecessary energy, while also protecting the portions of the individual's hand 12 and wrist 18 most susceptible to injury, e.g., the area of the palm directly under the middle, ring and little fingers, the middle of the palm and the radial side of the wrist 18.

Figure 6:
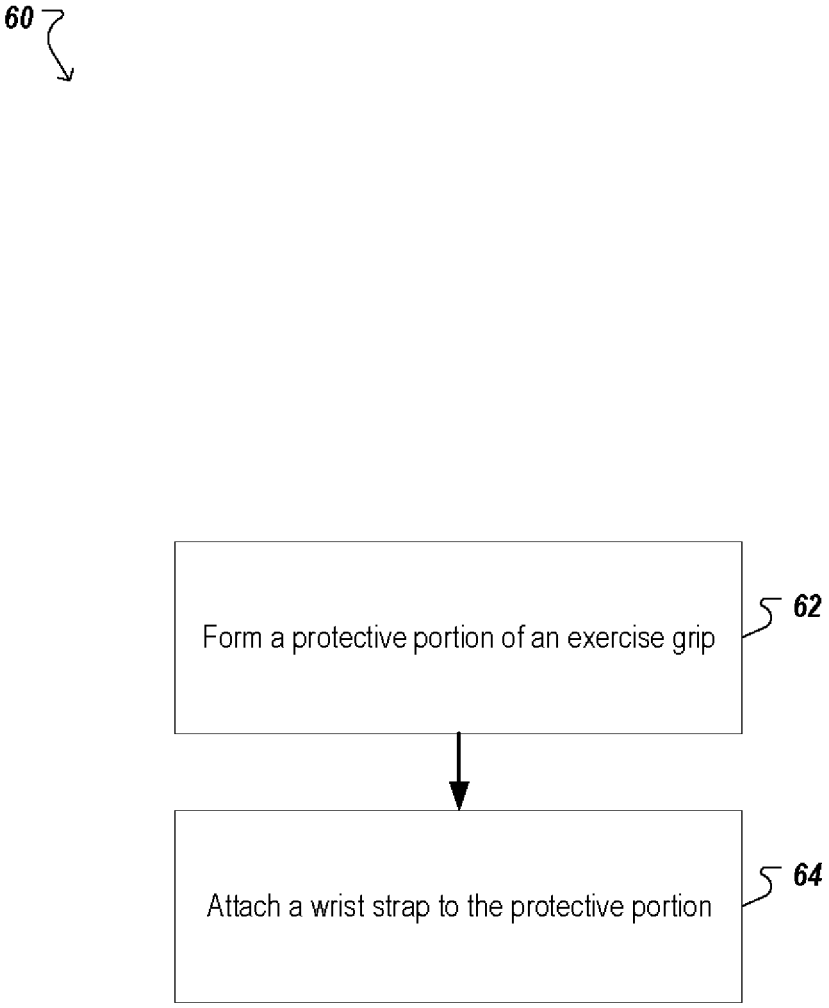
FIG. 6 is a flow chart of an example process for making an exercise grip.

FIG. 6 is a flow chart of an example process 60 for making an exercise grip. In some implementations, the process includes forming a protective portion of an exercise grip (62). The protective portion can be formed, for example, from a continuous piece of flexible material. For example, leather, neoprene, or rubber can be used to form the protective portion.

The protective portion of the exercise grip can be formed, for example, to have a wrist end and a finger end. The finger end can have three finger holes defined therein, as discussed above, or four finger holes defined therein as discussed in more detail below with reference to FIG. 7. For example, the finger end can be formed to have a middle finger hole, a ring finger hole, and a pinky finger hole. The locations of the middle finger hole, ring finger hole, and pinky finger hole can be formed at locations of the protective portion at which a middle finger, ring finger, and pinky finger will be respectively received when the protective portion is placed on a hand. When the finger end is formed to have four holes defined therein, the fourth hold can be formed at a location of the protective portion at which an index finger will be received when the protective portion is placed on the hand.

In some implementations, the middle finger hole is formed at a first distance from the wrist end, the ring finger hole is formed at a second distance from the wrist end, and the pinky finger hole is formed at a third distance from the wrist end. As discussed above, in three finger hole implementations, the middle finger hole can be at a largest distance from the wrist end (e.g., as measured to the center of the middle finger hole), the ring finger can be at a second largest distance from the wrist end (e.g., as measured from the center of the ring finger hole), and the pinky finger hole can be at the shortest distance from the wrist end (e.g., relative to the locations of the middle finger hole and the ring finger hole). In four finger hole implementations, the index finger hole can be further from the wrist end than the middle finger hole. Alternatively, the index finger hole can be formed at a same distance from the wrist end as the middle finger hole or formed at a distance from the wrist end that is between the distance from the wrist end of the middle finger hole and the ring finger hole.

The length of the protective portion extends, for example, from the finger end to the wrist end, and the width of the protective portion can be formed to vary along the length of the protective portion. For example, the protective portion can be formed to have a widest width at the wrist end. The finger end can have a width that is smaller than the width of the wrist end. The protective portion can be formed such that the width of the protective portion can vary between the wrist end and the finger end, with at least one portion of the protective portion having another width that is smaller than the width of the finger end (e.g., as measured at the pinky hole) and smaller than the width of the wrist end.

The process can also include attaching a wrist strap to the protective portion (64). A wrist strap similar to that discussed above with respect to FIG. 3 can be attached to the protective portion. The wrist strap can be attached, for example, by sewing, gluing, or otherwise attaching the wrist strap to the protective portion.

Figure 7:
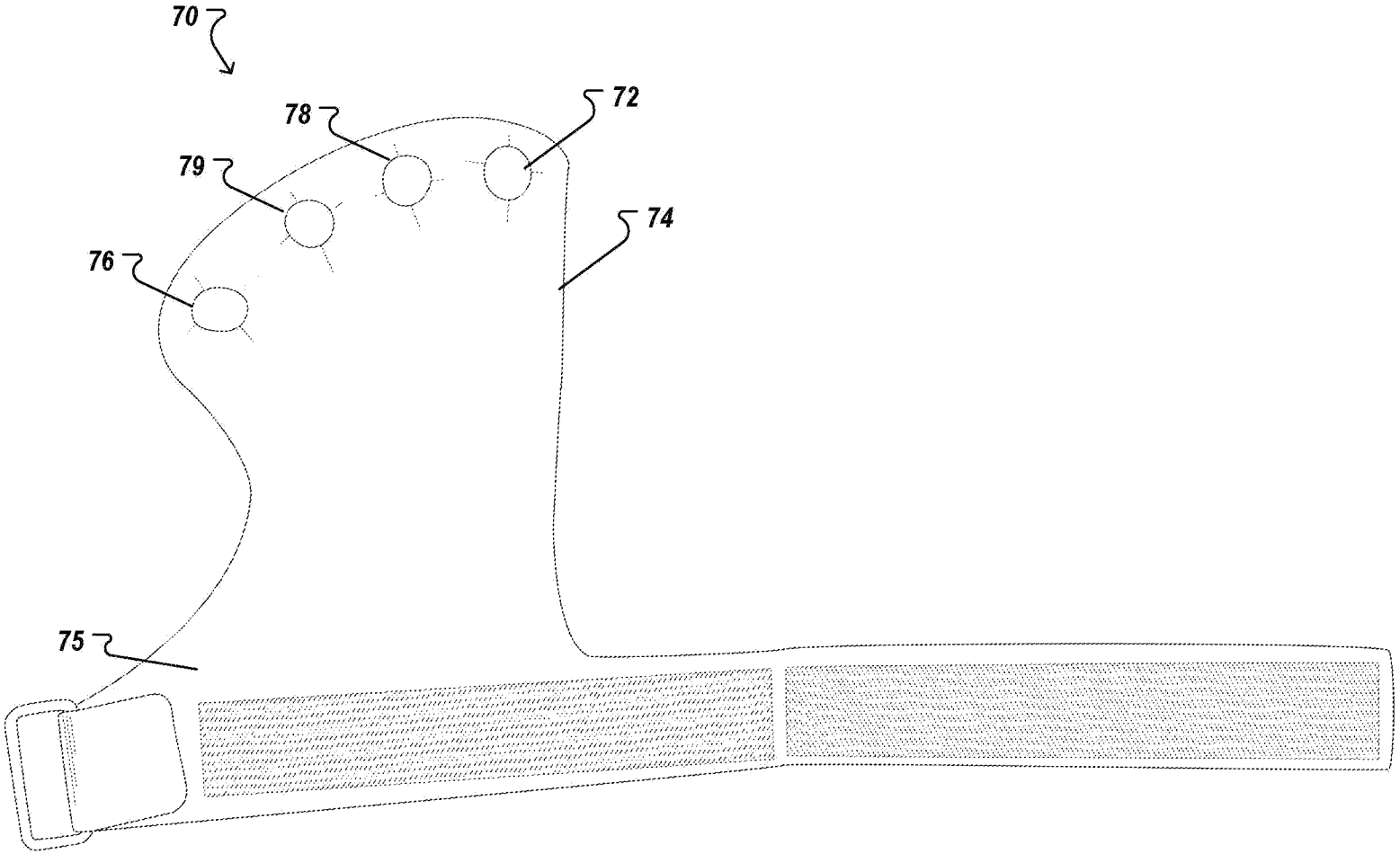
FIG. 7 is another drawing of an example exercise grip.

FIG. 7 is a drawing of another example exercise grip 70. The exercise grip 70 is similar to the exercise grips discussed above, but includes a fourth finger hole 72 that is formed at a location of the protective portion 74 at which the index finger of a hand will be received when the exercise grip 70 is worn. As illustrated by FIG. 7, the length of the protective portion 74 from the wrist end 75 can vary with the distance of the various finger holes. For example, the length of the protective portion 74 corresponding to the index finger hole is longer than the length of the protective portion 74 corresponding to the pinky finger hole 76. As illustrated, the exercise grip 70 also includes a middle finger hole 78 and a ring finger hole 79, which are both formed in a manner similar to that described above.

Figure 8:
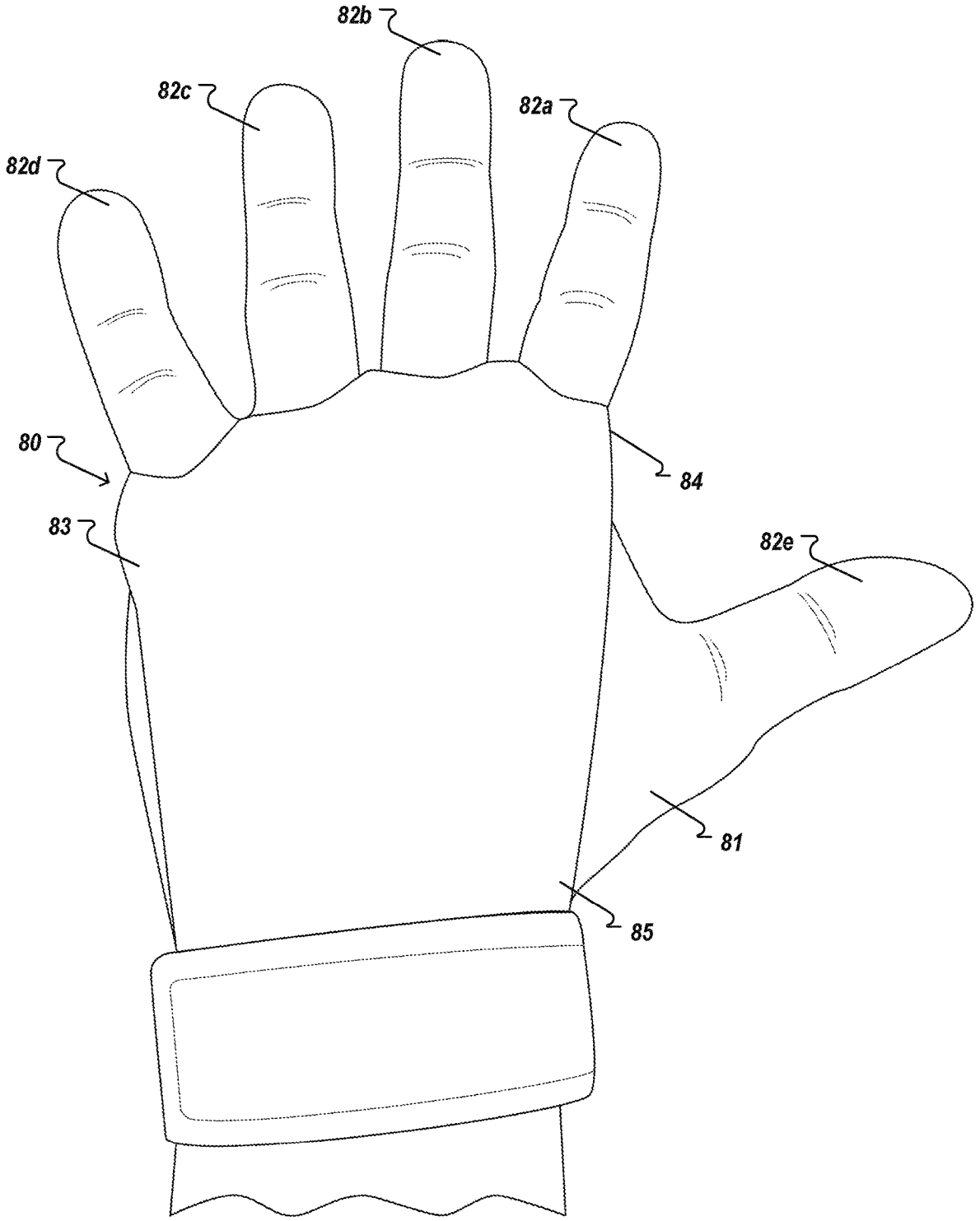
FIG. 8 is another drawing of an example exercise grip on a hand.

FIG. 8 is another drawing of an example exercise grip 80 on a hand 81. As shown in FIG. 8, the grip 80 has four finger holes through which the index finger 82*a*, middle finger 82*b*, ring finger 82*c*, and pinky finger 82*d* are inserted. As illustrated in FIG. 8, the grip 80 does not include a thumb hole, and the thumb 82*e* remains outside of the grip 80. The grip 80 includes a protective portion 83, which is wider at a finger end 84 of the grip than the width of the wrist end 85 of the grip.

Particular embodiments of the subject matter have been described. Other embodiments are within the scope of the following claims. In some cases, the actions recited in the claims can be performed in a different order and still achieve desirable results.

What is claimed is:

1. An exercise grip comprising:

a wrist strap having an open loop on one side, wherein the open loop is configured to receive an opposite end of the wrist strap; and a protective portion that has a palm end and a finger end, wherein:

the palm end is located closer to the wrist strap than the finger end;

a first edge of the protective portion is closer to the open loop than a second opposite edge of the protective portion;

a first width of the finger end is smaller than a second width of the palm end, wherein the second width is measured along an axis defined by a top edge of the wrist strap located between the first edge and the second opposite edge, wherein the top edge of the wrist strap is more proximate to the finger end than a bottom edge of the wrist strap;

the first edge is shorter than the second opposite edge; and a vertex of a first concave segment defined by the first edge is (i) between the top edge of the wrist strap and the finger end, and (ii) more distal from the top edge of the wrist strap than a vertex of a second concave segment defined by the second opposite edge of the protective portion.

2. The exercise grip of claim 1, wherein the first concave segment defined by the first has a more concave shape than the second concave segment defined by the second opposite edge of the protective portion.

3. The exercise grip of claim 2, wherein the finger end comprises a top edge of the protective portion that extends between the first edge and the second opposite edge.

4. The exercise grip of claim 3, wherein the top edge is formed at an angle relative to the wrist strap.

5. The exercise grip of claim 4, wherein the first edge has a section that is further away from a center axis of the protective portion than the second opposite edge.

6. The exercise grip of claim 5, wherein the protective portion is a continuous flexible material.

7. The exercise grip of claim 6, wherein the continuous flexible material is at least one of leather, neoprene, or rubber.

8. The exercise grip of claim 7, wherein the protective portion has finger holes defined therein.

9. The exercise grip of claim 8, wherein the finger holes are formed though a plane of the protective portion that is defined by the palm end, the finger end, the first edge, and the second opposite edge.

10. A method of forming an exercise grip, comprising:

forming a wrist strap having an open loop on one side, wherein the open loop is configured to receive an opposite end of the wrist strap;

forming a protective portion that has a palm end and a finger end, wherein:

the palm end is located closer to the wrist strap than the finger end;

a first edge of the protective portion is closer to the open loop than a second opposite edge of the protective portion;

a first width of the finger end is smaller than a second width of the palm end, wherein the second width is measured along an axis defined by a top edge of the wrist strap located between the first edge and the second opposite edge, wherein the top edge of the wrist strap is more proximate to the finger end than a bottom edge of the wrist strap;

the first edge is shorter than the second opposite edge; and a vertex of a first concave segment defined by the first edge is (i) between the top edge of the wrist strap and the finger end, and (ii) more distal from the top edge of the wrist strap than a vertex of a second concave segment defined by the second opposite edge of the protective portion.

11. The method of claim 10, wherein the first concave segment defined by the first edge has a more concave shape than the second concave segment defined by the second opposite edge of the protective portion.

12. The method of claim 11, wherein the finger end comprises a top edge of the protective portion that extends between the first edge and the second opposite edge.

13. The method of claim 12, wherein the finger end is formed at an angle relative to the wrist strap.

14. The method of claim 13, wherein the first edge has a section that is further away from a center axis of the protective portion than the second opposite edge.

15. The method of claim 14, wherein the protective portion is a continuous flexible material.

16. The method of claim 15, wherein the continuous flexible material is at least one of leather, neoprene, or rubber.

17. The method of claim 16, wherein the protective portion has finger holes defined therein.

18. The method of claim 17, wherein the finger holes are formed though a plane of the protective portion that is defined by the palm end, the finger end, the first edge, and the second opposite edge.

* * * * *